United States Patent [19]

Ferri

[11] 4,076,168

[45] Feb. 28, 1978

[54] CARTON FOR FOOD PRODUCTS

[76] Inventor: Luigi Ferri, Via Belfiore 24, Turin, Italy

[21] Appl. No.: 731,774

[22] Filed: Oct. 12, 1976

[30] Foreign Application Priority Data

| | | |
|---|---|---|
| Oct. 15, 1975 | Switzerland | 013480/75 |
| Aug. 6, 1976 | Switzerland | 010114/76 |

[51] Int. Cl.[2] ..... B65D 43/22; B65D 5/46

[52] U.S. Cl. ..... 229/43; 229/52 A; 229/78 A

[58] Field of Search ..... 229/52 A, 52 AL, 52 AC, 229/52 AM, 48 T, 54 C, 78 A, 30, 43

[56] References Cited

U.S. PATENT DOCUMENTS

| | | | |
|---|---|---|---|
| 491,148 | 2/1893 | Turck | 229/78 A |
| 1,092,209 | 4/1914 | Greve | 229/78 A X |
| 1,147,745 | 7/1915 | Neinken et al. | 229/52 AC UX |
| 2,001,476 | 5/1935 | Vogt | 229/52 A MX |
| 2,039,971 | 5/1936 | Meinhardt | 229/52 A |
| 2,667,297 | 1/1954 | McReary | 229/52 A X |
| 3,064,876 | 11/1962 | Warner | 229/43 |
| 3,120,727 | 2/1964 | Ziliox | 229/43 X |
| 3,636,594 | 1/1972 | Faivre | 229/52 A UX |
| 3,893,566 | 7/1975 | Ross | 229/43 X |
| 3,967,774 | 7/1976 | Querner | 229/43 X |

*Primary Examiner*—Davis T. Moorhead
*Attorney, Agent, or Firm*—Flynn & Frishauf

[57] ABSTRACT

A receptacle for the retail packaging of cakes, pastries and confectionery formed of two similar thin-walled card trays placed face to face to abut peripherally and connected together in the closed position by connecting means associated with tabs extending longitudinally of the sidewall edges of the trays. The receptacle end walls may overlap to assist closure of the receptacle.

6 Claims, 27 Drawing Figures

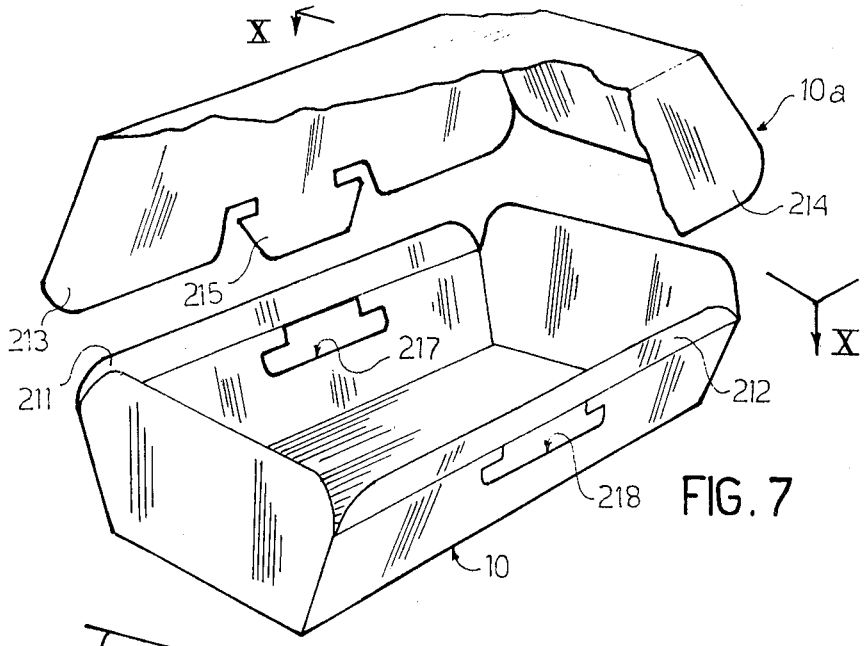
FIG. 7
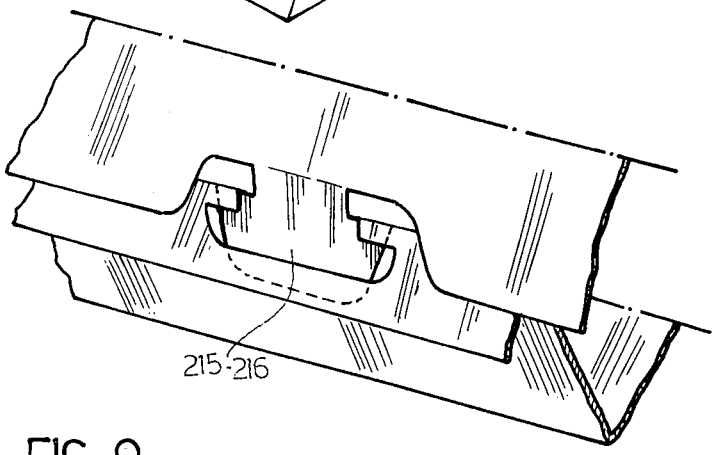
FIG. 8
FIG. 9
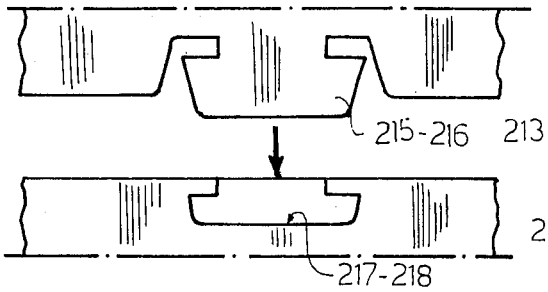
FIG. 10
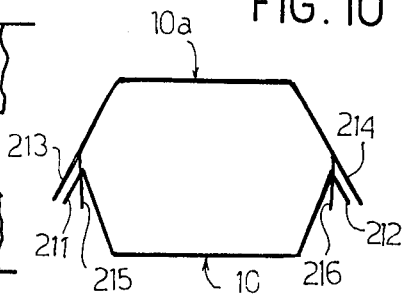

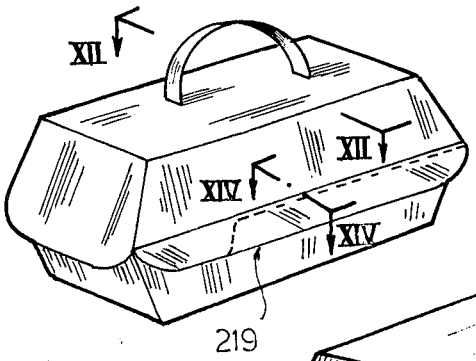
FIG. 11
FIG. 12
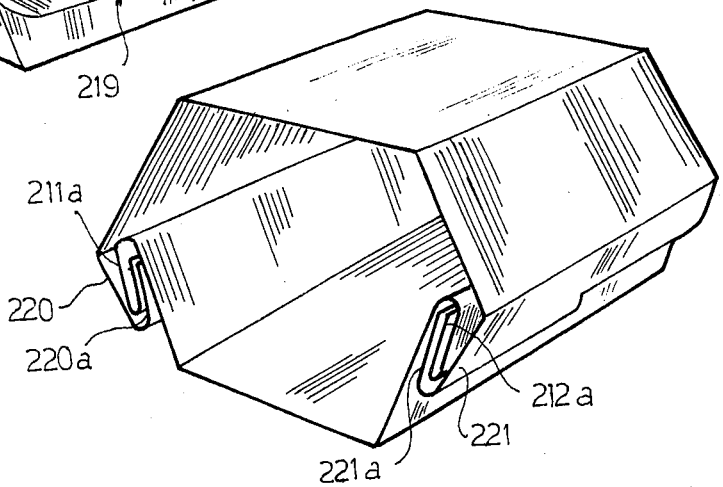
FIG. 13
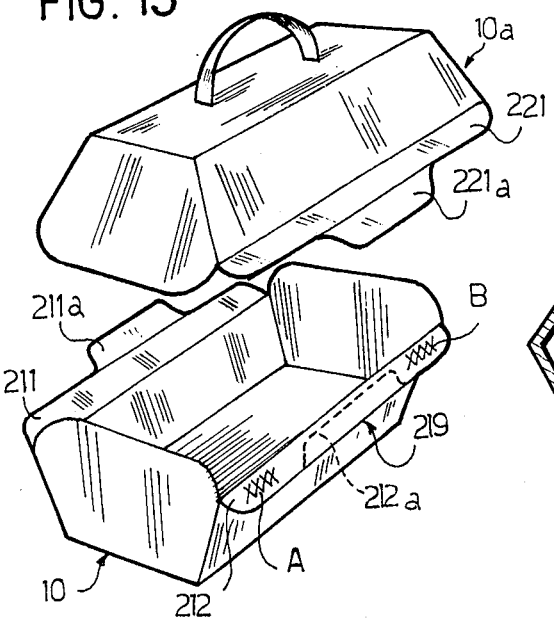
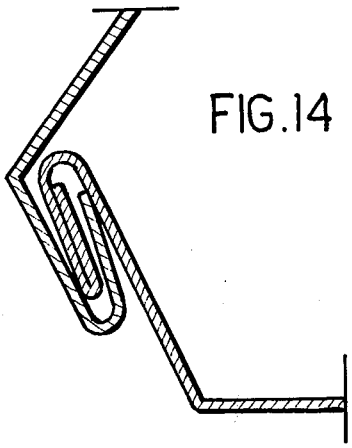
FIG. 14

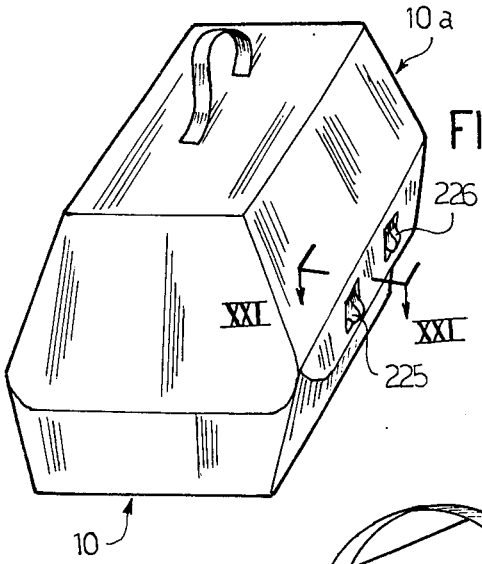
FIG.19
FIG. 21
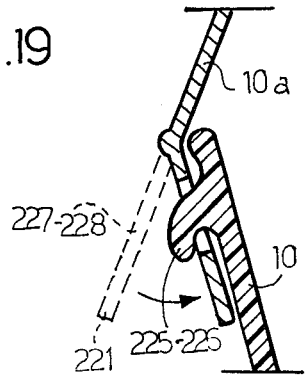
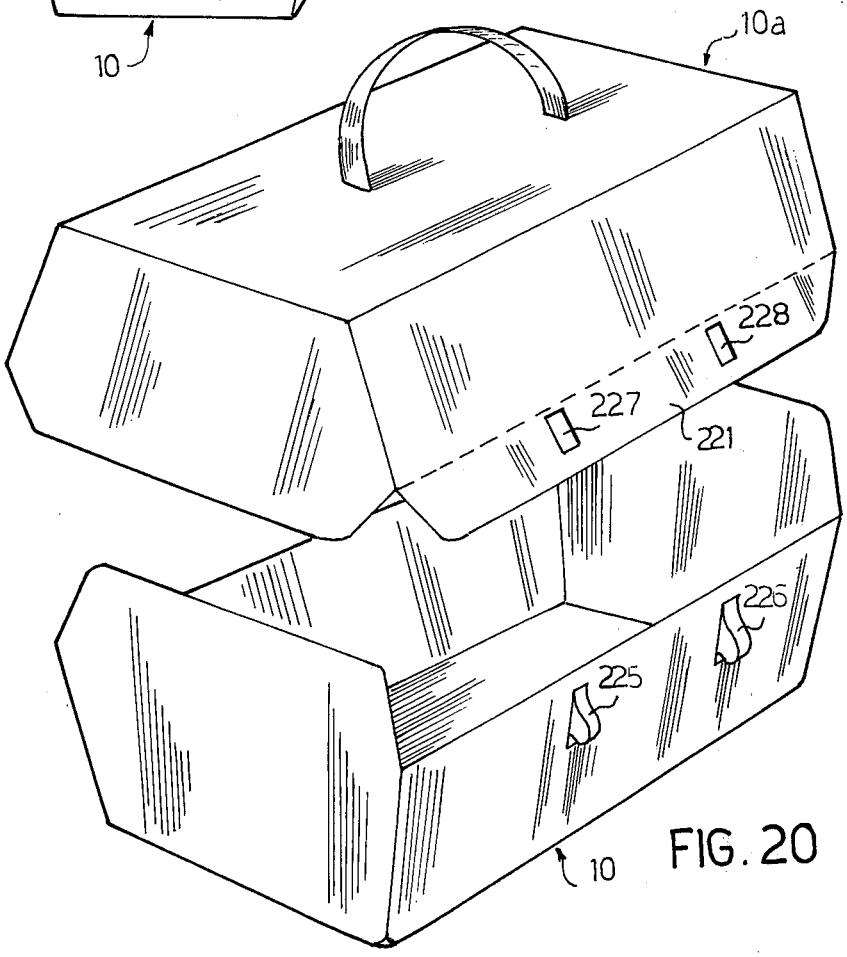
FIG. 20

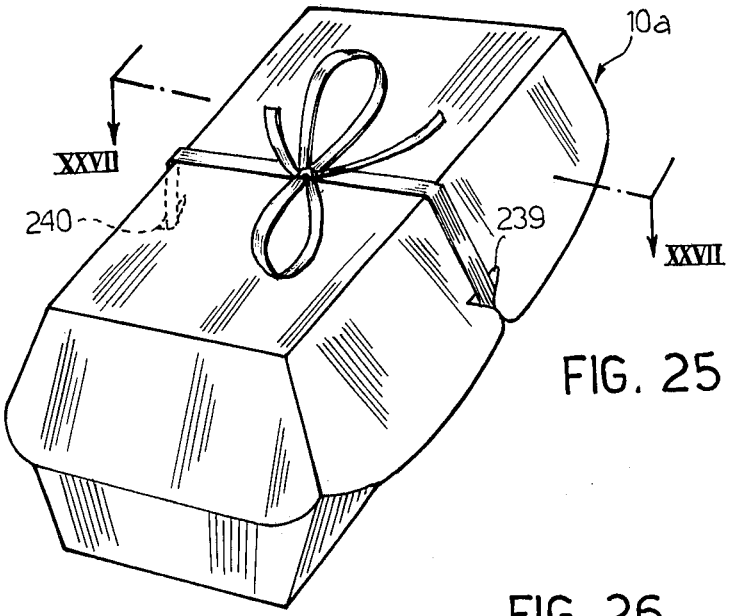
FIG. 25
FIG. 26
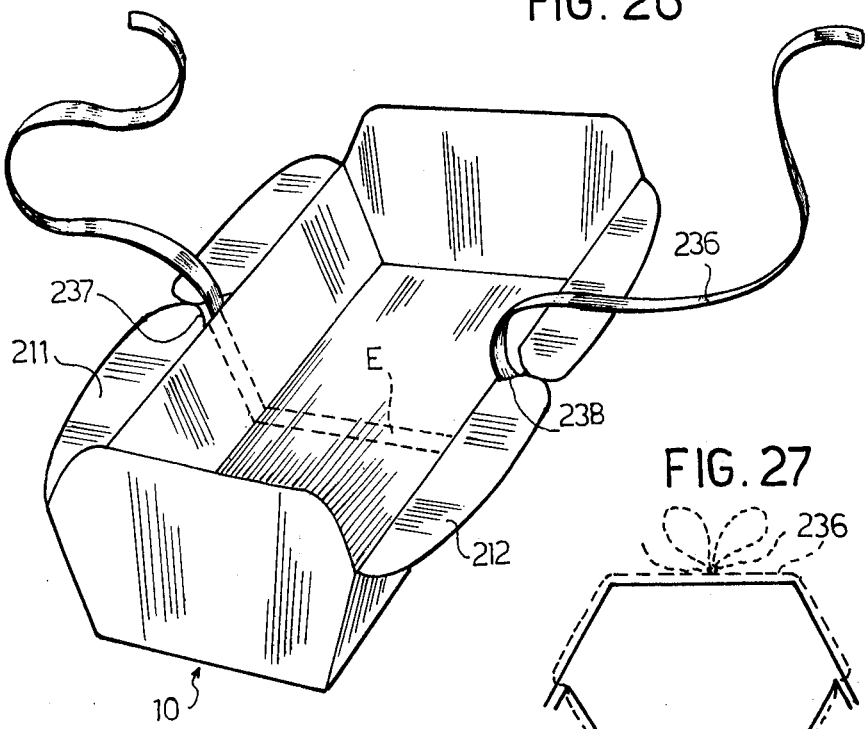
FIG. 27
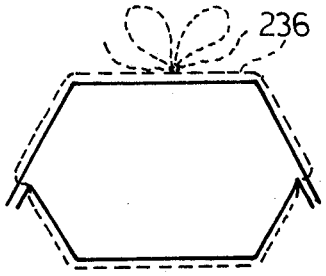

CARTON FOR FOOD PRODUCTS

FIELD OF THE INVENTION

This invention relates to receptacles for the retail packing and display of delicate foodstuffs, particularly for fresh confectionery.

As is well known, delicate foodstuffs, such as pies, pastries and fresh confectionery in general, are often packed for retail sale, by means of a thin card tray and protection strips also made of thin cardboard stock, the tray then being placed in a paper packet which is closed by bands, cords, adhesive tapes or staples.

Such known packing systems provide insufficient protection for the packed food product; require laborious, time-consuming and careful operations; and may be detrimental to the hygiene of the packed product.

An object of the present invention is to avoid said disadvantages. Particular objects of the present invention are to provide a receptacle which will substantially simplify the packing for retain sale of delicate foodstuffs; to provide a receptacle adapted to be stored in stacks of superposed receptacles so as to require reduced storage space; to provide a receptacle which is sturdy and will efficiently protect the product packed therein, while at the same time being easily transportable; to provide a receptacle which, in addition to being utilizable for packing, is also suitable for the display of the packed products and can be used as a tray from which to eat the products; and to provide a receptacle which can be manufactured economically and which can ensure better hygienic conditions for the food product packed therein.

SUMMARY OF THE INVENTION

The invention provides a receptacle for the packaging of delicate foodstuffs, particularly fresh confectionery, characterised in being formed by two substantially identical half-receptacles or half-shells, made of thin cardboard stock, disposed face to face in the manner of a lid and a base to abut peripherally along tabs extending outwardly from the edges of at least two opposite sidewalls, said tabs being arranged to receive restraining means for the mutual connection of the two superposed half-receptacles.

According to one embodiment each half-receptacle has two opposite sidewalls provided with such tabs, the other two sidewalls having no tabs and being extended so as to overlap with the corresponding sidewalls of the superposed inverted half-receptacle to assist location of the half-receptacles during closure.

The sidewalls with no tabs may advantageously be provided with slots serving as handles, so that when the package is opened, the half-receptacle may be used as a display tray or a picnic tray.

In a modified embodiment, each sidewall of the half-receptacles is provided with said tabs, so that the abutment of the two half-receptacles takes place along the full length of the common periphery.

The connection between the half-receptacles may be effected by means of staples through the abutting tabs, or by adhesive on such tabs. The mutual connection of the half-receptacles may also be achieved simply by means of a band or cord, or by connecting the abutting tabs to one another by means of an adhesive tape.

However, the use of staples may not comply with regulations in some countries, and also the use of presprayed adhesive materials may be inadvisable because of the drying of the adhesive, when the packing is expected to be stored for a long period of time before being used.

Accordingly the half-receptacles may be provided with mechanical connection means secured to or formed integrally with at least one of said half-receptacles. For example in one embodiment one half-receptacle is provided with tongues and the tabs of the other half-receptacle are provided with slits or shaped to form pockets to receive said tongues. Metal inserts may be provided to prevent disengagement of said tongues from said pockets.

In another embodiment hooks are provided on one half-receptacle to cooperate with corresponding slots formed on the other half-receptacle. This is particularly advantageous when one of the half-receptacles, generally the one which constitutes the bottom half, is made of a mouldable material, for instance a polymeric material, or of card coated with a polymeric material.

A further modification consists in the use of a simple binding band which passes through retaining seats formed in at least one pair of tabs of the base half-receptacle, and preferably secured onto one of the half-receptacles.

Another modification consists in the use of a flexible closure band provided with T-shaped end heads which are inserted, like buttons, into slots formed on the tabs of the base half-receptacle, after having passed the band itself over the lid half-receptacle.

BRIEF DESCRIPTION OF THE DRAWINGS

The invention will be better understood through the following detailed description and with reference to the accompanying drawings, given by way of example, wherein:

FIGS. 7 to 10 are perspective views showing, in detail and in diagrammatic cross-sections, a receptacle according to a third embodiment which includes mechanical connection elements;

FIGS. 11 to 14 are perspective views and corresponding enlarged cross-sections along lines XII—XII and XIV—XIV of FIG. 11, showing a receptacle according to a fourth embodiment in which the tabs of one half-receptacle form pockets;

FIGS. 19 and 20 are perspective views of a receptacle according to a sixth embodiment in which at least one half-receptacle is made of polymeric material;

FIG. 21 is an enlarged cross-section along line $XX_i$—$XX_i$ of FIG. 19;

FIGS. 25 to 27 are perspective and sectional views showing an eighth embodiment.

DESCRIPTION OF THE PREFERRED EMBODIMENTS

Figure 1:
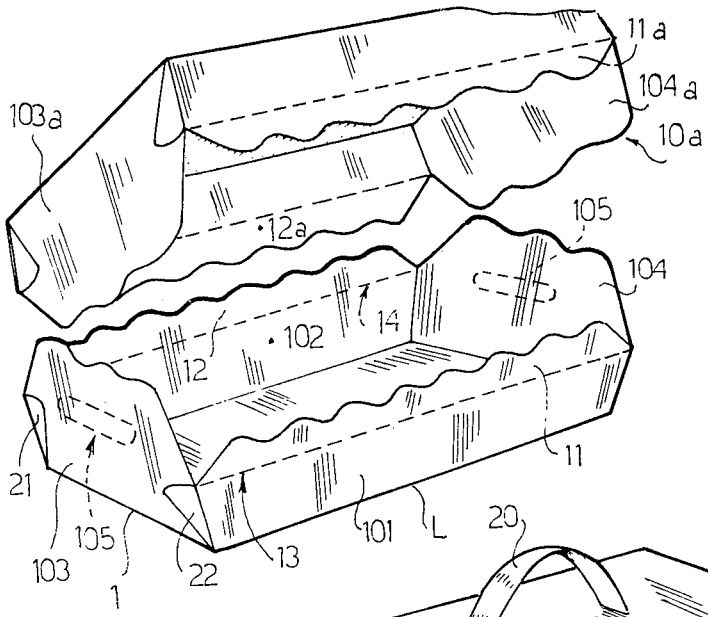
FIG. 1 is a perspective view showing two half-receptacles adapted to abut peripherally to form a receptacle according to the invention.

Referring now to FIGS. 1 to 4, reference numerals 10–$10_1$ indicate two half-receptacles adapted to abut peripherally to form a receptacle for delicate foodstuffs, according to the present invention. These half-receptacles are substantially identical to one another and each of them comprises a substantially rectangular tray formed from plane sheet cardboard material and comprising a bottom portion 100 and two pairs of opposed sidewalls 101–102, and 103–104. The sidewalls of each pair are inclined towards one another towards the bottom of the tray. The angle of inclination, that is deviation from 90° is small — see FIG. 3 and is about 3°. The sidewalls are obtained by bending the card along lines L-1 which outline the bottom of the tray and are mutually connected by means of ears 21–22 formed by the extension of two opposite sidewalls, for example the sidewalls 101–102, which ears are pasted to the other two sidewalls 103–104.

The opposite and symmetrical sidewalls 101–102, which generally correspond to the larger sides if the bottom is rectangular, have a height above the bottom, which is lower than the height of the sidewalls 103–104. Each sidewall 101–102 is provided with a tab 11, 12, respectively, extending longitudinally of the edge of the sidewall. The tabs 11, 12 are bent outwardly of the half-receptacle along a fold line 13, 14 respectively. The height of said sidewalls provided with tabs is equal to one half of the height of the receptacle formed by the superposition of the two half-receptacles 10–$10_a$, so that after the superposition has been accomplished the corresponding tabs 11–$11_a$, 12–$12_a$ register and abut in area contact, as shown in FIG. 2, in order to allow the connection of said half-receptacles.

Figure 2:
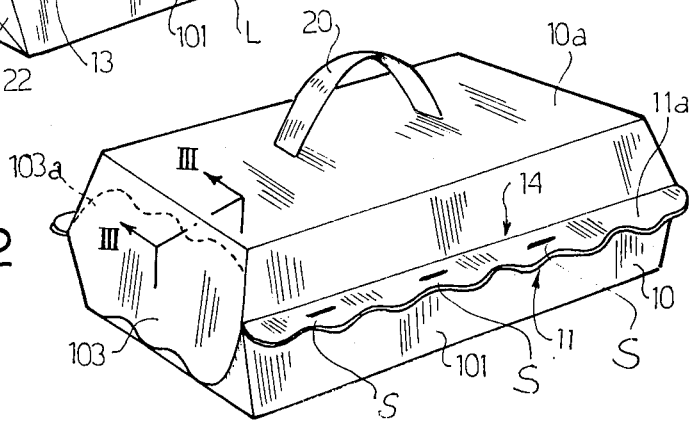
FIG. 2 is a perspective view showing the closed receptacle.
Figure 4:
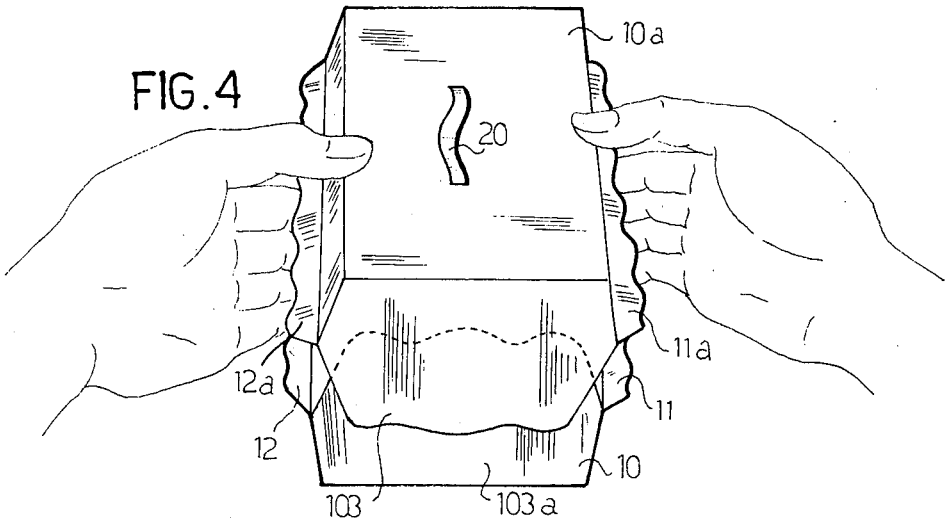
FIG. 4 is a perspective view showing the operation of superposing the two half-receptacles.
Figure 3:
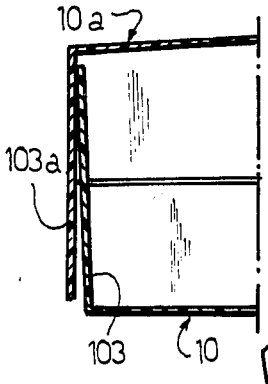
FIG. 3 is an enlarged cross-section along line III—III of FIG. 2.

Conversely, the height of the sidewalls 103–104 having no tabs thereon is chosen substantially equal to or slightly lower than that of the final receptacle, so that upon superposing the two half-receptacles 10–$10_a$, the corresponding sidewalls 103–$103_a$, 104–$104_a$ will slidingly overlap each other, as shown by dashed lines in FIG. 2 and as clearly appears from FIG. 3, thereby facilitating the mutual centering and location of the two half-receptacles, and forming substantially continuous sidewalls of the receptacle, so that the packing will be closed and its interior inaccessible. The small angle of inclination does not inhibit this telescoping fit of sidewalls 103–$103_a$, 104–$104_a$ due to the inherent flexibility of packing-type cardboard.

For the connection of the superposed half-receptacles the projecting tabs 11–$11_a$, 12–$12_a$ are used. These tabs may be fastened to one another by means of staples 8 (FIG. 2) or by means of lengths of adhesive tape. It is also possible to spray an adhesive material on the matching surfaces of the tabs and then to cover said surfaces, in a well known way, with a protective film which will be removed when using the half-receptacles; the connection of the half-receptacles being then effected by exerting pressure on the tabs to obtain the setting of the adhesive material. It is also possible to close the container, after having accomplished the packing, by means of a simple band or cord or the like, received by the tabs.

Figure 5:
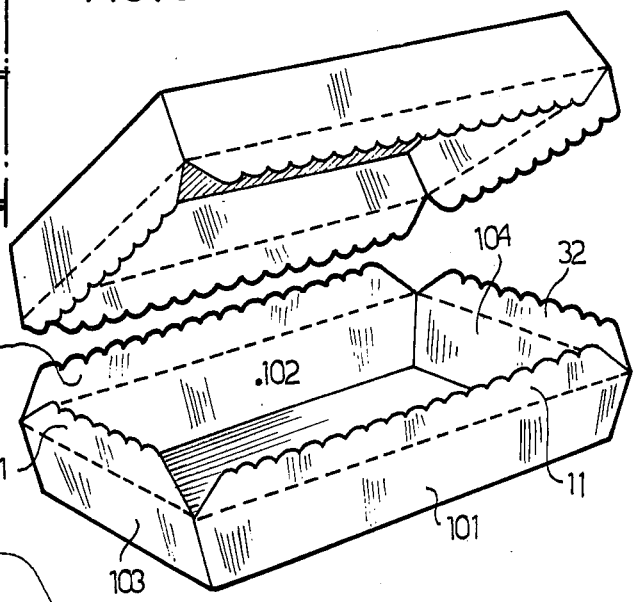
FIG. 5 is a perspective view similar to that of FIG. 1, but showing a second embodiment of the invention.
Figure 6:
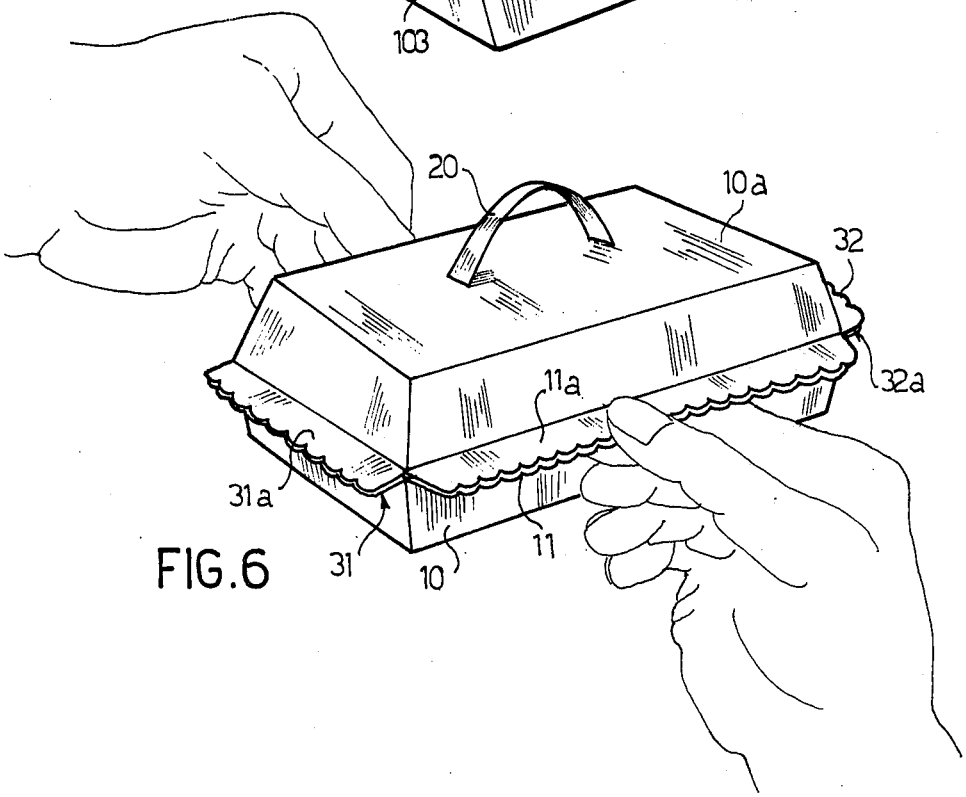
FIG. 6 is a perspective view showing the completed receptacle according to the embodiment shown in FIG. 5.
Figure 16:
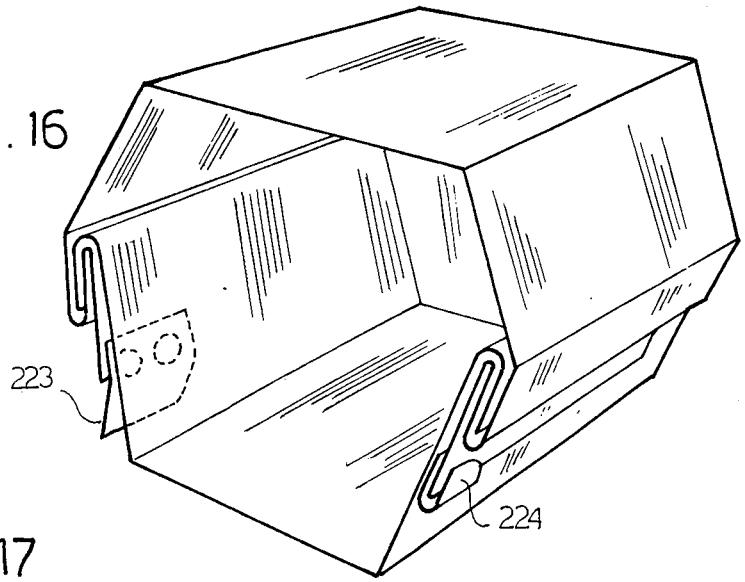
FIGS. 15 and 16 are, respectively, an exploded perspective view and a cross-section along line XVI'XVI of FIG. 15, showing a receptacle in a fifth embodiment similar to the preceding one but provided with metal clamping inserts.
Figure 17:
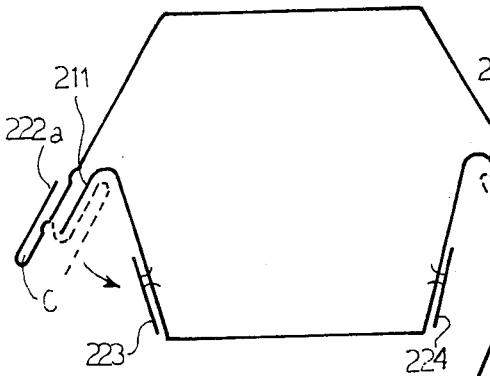
FIGS. 17 and 18 are diagrammatical cross-sectional views of the receptacle according to the embodiment shown in FIGS. 15 and 16, showing the manner of use of said metal inserts.
Figure 15:
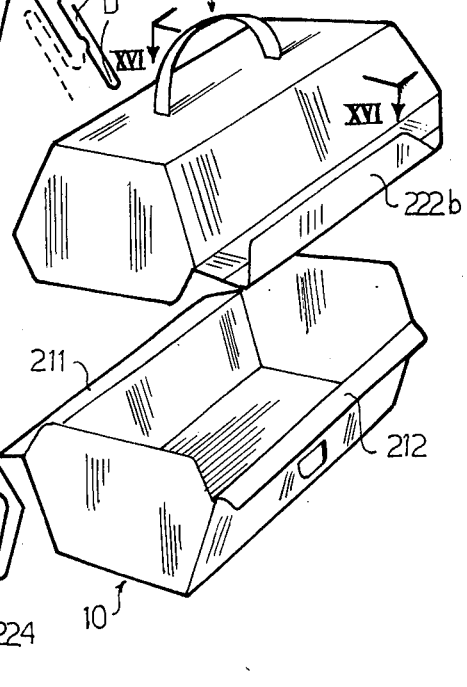

FIG. 5 shows an embodiment of the invention in which all the sidewalls 101, 102, 103, 104 of each half-receptacle have the same height above the bottom and terminate with connection tabs 11, 12, 31, 32. In this case, the packing will be carried out by superposing the two half-receptacles 10–$10_a$ in such a way as to have the corresponding tabs abutting in area contact along the whole periphery, as clearly shown in FIG. 6. The connection will be achieved as in the preceding case by means of staples, adhesive tape or interposed adhesive material.

To facilitate the transport of the closed receptacle after having accomplished the packing, it is advantageous to provide the half-receptacle $10_a$, which serves as lid, with a handle 20 which may be formed for example by means of a strip of cloth, or by means of an insert of cardboard shaped like a handle.

Since the half-receptacles 10–$10_a$ have their sidewalls symmetrically inclined, they may be stacked on each other for storage purposes, thereby obtaining a disposition of minimum overall dimensions. Moreover, due to their configuration, the half-receptacles may assume the function of trays both for display purposes of the food product to be sold and for serving the products for consumption after having opened the packing. To this end it is advantageous to provide the sidewalls 103, 104, as shown in FIGS. 1 to 4, with slots 105 shaped like a handle, so that the half-receptacle will serve as a tray.

Referring now to FIGS. 7 to 10, it can be seen that the half-receptacle 10, which forms the bottom, is provided with peripheral tabs 211–212 intended to be bent outwardly, while the upper half-receptacle $10_a$ has continuous sidewalls 213–214. Each of these sidewalls is formed with a tongue 215, 216, respectively, having a button-shaped profile. Correspondingly, the sidewalls of the base half-container 10 are provided, beneath the tabs 211, 212, with cuts 217, 218 having a profile which is substantially conjugate with that of the tongues, so that the cut out portion of the cuts corresponds approximately to the body of the tongues. This allows obtaining a tonguing connection between the two half-receptacles, after having bent the tabs 211, 212 outwardly and downwardly, by inserting the tongues into the cuts, the connection being substantially similar to a button-buttonhole connection.

In the modified embodiment shown in FIGS. 11–14, it can be seen that the tabs 211–212 of the lower half-receptacle 10 are provided with an extension 211$_a$–212$_a$ in their central portion. The tabs are bent downwardly and their outer longitudinal edge portions are pasted to the sidewall of the half-receptacle in the regions A-B. In this way a central pocket 219 is formed, inside which the respective extension 211$_a$, 212$_a$, respectively is turned over for the purpose of stiffening.

As shown in the Figures, also the upper half-receptacle is provided with tabs 220–221 having respective tongues 220$_a$–221$_a$. To obtain the desired connection, after having superposed the lid onto the bottom, the tongues 220$_a$–221$_a$ are inserted into the corresponding pockets 219, by bending them upwards, as shown in FIG. 12.

The embodiment shown in FIGS. 15 to 18 is similar to the preceding one. It differs in that the tabs 211–212 of the lower half-receptacle are not pocket-shaped but are simply bent downwards and that the tabs 220–221 of the upper half-receptacle are provided with an extension $222_a$–$222_b$ which is bent over itself and is partially pasted in the zones shown at C and D in FIG. 17 so that their end portion forms a free limb. Moreover, the lower half-receptacle 10 is provided, at the two sidewalls, with metal inserts formed preferably by clinched or thermowelded aluminium plaques 223–224.

Figure 18:
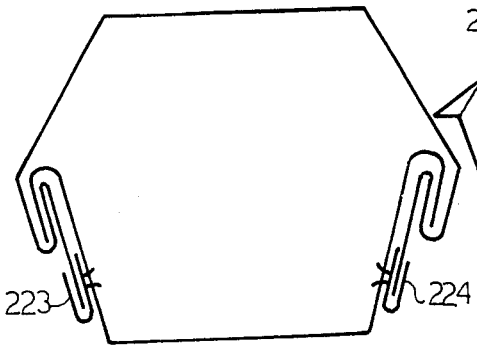

Also in this case the connection between the two half-receptacles is obtained by bending and inserting the extensions $222_a$–$222_b$ of the upper half-receptacle below the tabs 211–212 of the lower half-receptacle and fastening the free limbs of said extensions by means of the plaques 223–224 which are bent upwardly, as clearly shown in FIG. 18. The closure obtained in this way prevents the extensions from being disengaged from the tabs and is particularly suitable for carrying the receptacle by means of its handle.

In the embodiment shown in FIGS. 19 to 21 the lower half-receptacle 10 is made of a mouldable material which may advantageously be a polymeric material, or of cardboard coated, at least partially, with said material, and is provided, on the outer face of each sidewall, with one or more hooks as 225–226. These hooks, which are formed, by moulding, in the material of the half-container, have an undercut-like profile and are arranged to engage corresponding slots, as 227–228, formed on the tabs 220–221 of the upper half-receptacle $10_a$ made of cardboard.

Figure 22:
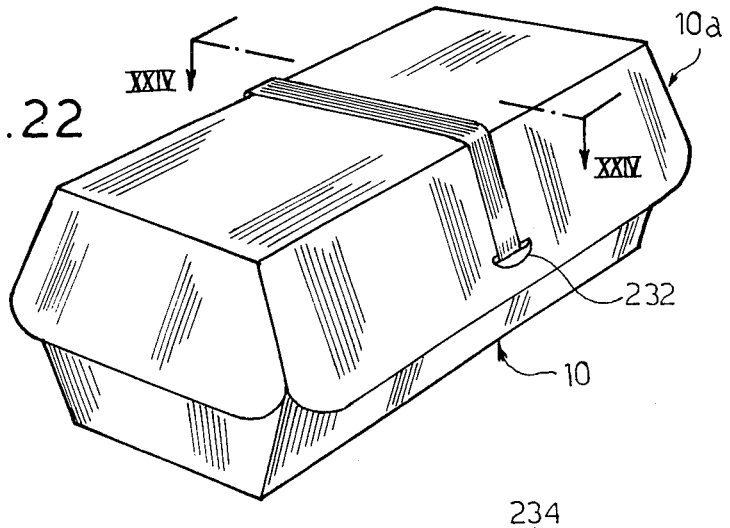
FIGS. 22 to 24 are perspective and sectional views showing a seventh embodiment using a flexible closure band.
Figure 23:
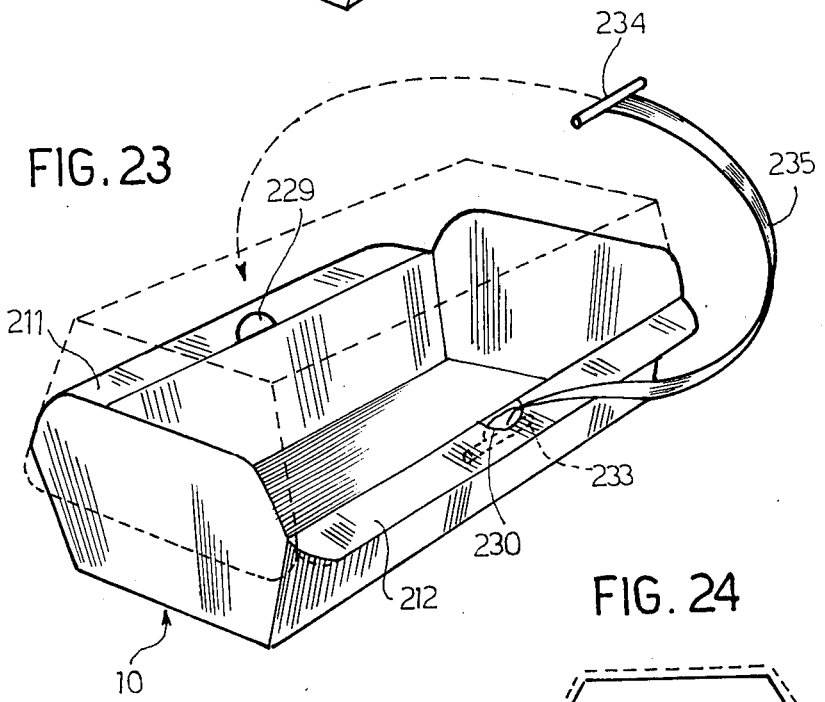
Figure 24:
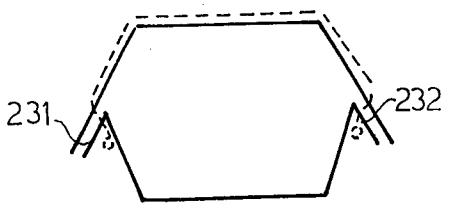

In the embodiment according to FIGS. 22 to 24, the tabs 211–212 of the lower half-receptacle are provided with slots 229–230 and the sidewalls of the upper half-receptacle are provided with openings 231–232. Engaged with the slots 229–230 are the T-shaped ends 233–234 of a band 235. One end of the band 235, for example the end 233, is engaged like a button in the corresponding slot 230; the other end is then inserted into the opening 232 of the lid, passed over the latter, inserted into the opening 231 and then "buttoned" to the opposite slot 229 of the lower half-receptacle. As shown in the Figure, the band, besides providing the closure, serves also as a handle for facilitating the transport.

In the embodiment shown in FIGS. 25 to 27, the closure of the receptacle is carried out by means of a simple strip 236. With a view to facilitating the binding operation, passage slots 237–238 are provided in the tabs of the lower half-receptacle and passage slots 239–240 are provided in the corresponding sidewalls of the half-receptacle which constitutes the lid. The slots are preferably provided with cuts, so that the band will not have to be threaded into but simply forced through the cuts. It is also advantageous to permanently fasten the band to the half-receptacle by means of glueing, at least at the bottom, for example in the region shown at E.

I claim:

1. A hollow receptacle for the retail packaging of delicate food products, particularly fresh confectionary, comprising two separate essentially identical half-receptacles which are superimposable above one another to make a package with a chamber for the articles therein, and which may be separately used before or after packaging of the articles in form of trays for display and respectively support of food products, separately, on each half-receptacle;

wherein each half-receptacle comprises a bottom;

a first pair of opposed walls, said walls being provided with connecting tongues;

and a second pair of opposed walls having a height greater than that of first walls;

said connecting tongues on said first pair of walls being formed with engagement areas to fit said half-receptacles together said second walls being capable to engage one over another by reciprocal telescoping fit when said half-receptacles are arranged one turned over another to form an internally hollow package;

and connecting means to mutually connect the connecting tongues together.

2. A receptacle according to claim 1, wherein said first and second walls of each half-receptacle form an angle with said bottom greater than 90° so that a plurality of identical half-receptacles may be stacked within one another with the respective bottoms contacting one another, to form a stack of half-receptacles for transporting and storing purposes.

3. A receptacle according to claim 2, wherein the material of the half-receptacle is cardboard stock;

and wherein the angle of inclination is just slightly greater than 90° to permit stacking said half-receptacle for transport and storage purposes within one another, while still permitting said telescoping interengaging fit by said second walls, one over another, when the half-receptacles are assembled together to form said hollow receptacle.

4. A receptacle according to claim 3, wherein said angle is about 93°.

5. A receptacle according to claim 1, wherein the connecting means comprise metal staples which connect the tongues of said first pair of opposed walls.

6. A receptacle according to claim 1, wherein said connecting means comprises an adhesive layer on said tongues, and a removable film protecting said adhesive layer until exposure of the layer to effect said connection.

* * * * *